United States Patent [19]

Salvo

[11] 4,097,855

[45] Jun. 27, 1978

[54] ELECTRONIC TENNIS SCORING SYSTEM

[76] Inventor: Gaetano Salvo, 6117 Reseda Blvd., Reseda, Calif. 91335

[21] Appl. No.: 854,662

[22] Filed: Nov. 25, 1977

[51] Int. Cl.[2] ..... G08B 23/00; G08B 5/36

[52] U.S. Cl. ..... 340/323 R; 235/92 GA

[58] Field of Search ..... 340/323 R; 235/92 GA; 273/29

[56] References Cited

U.S. PATENT DOCUMENTS

| | | | |
|---|---|---|---|
| 3,653,026 | 6/1970 | Hurley | 340/323 R |
| 3,737,889 | 6/1973 | Sweeny | 340/323 R |

*Primary Examiner*—Donald J. Yusko

*Attorney, Agent, or Firm*—Poms, Smith, Lande & Glenny

[57] ABSTRACT

The present tennis scoring system includes input devices for each player to indicate whether one player or the other has won a particular point. These input devices for each player may be in the form of transmitters each having two recessed pushbutton switches, one to indicate that one player has won the point and the other to indicate that the opposing player has won the particular point.

The input device may take the form of a belt buckle size unit worn at the waist or on the wrist. Electronic scoring circuitry is provided which is responsive to the concurrent depressing of buttons by both players indicating who has won a particular point. Electronic scoring equipment keeps track of the points, games, sets and matches won by each player and each side. Suitable electronic equipment is provided to accommodate slight differences in the timing of the pressing of input switches by the two players. Special logic circuitry is provided for accommodating the tennis scoring situation involving deuce games. Transmitters with unique signals to indicate who has won a point are provided. A common display and annunciator unit may be used which receives signals from input devices of each player. Alternatively, small LED displays may be provided on each of the input units to display the points, games, sets and matches won by each player and each team. The annunciator may provide a unique sound to indicate points won by one player as compared with a different sound for points won by the other player.

14 Claims, 6 Drawing Figures

Fig. 1.
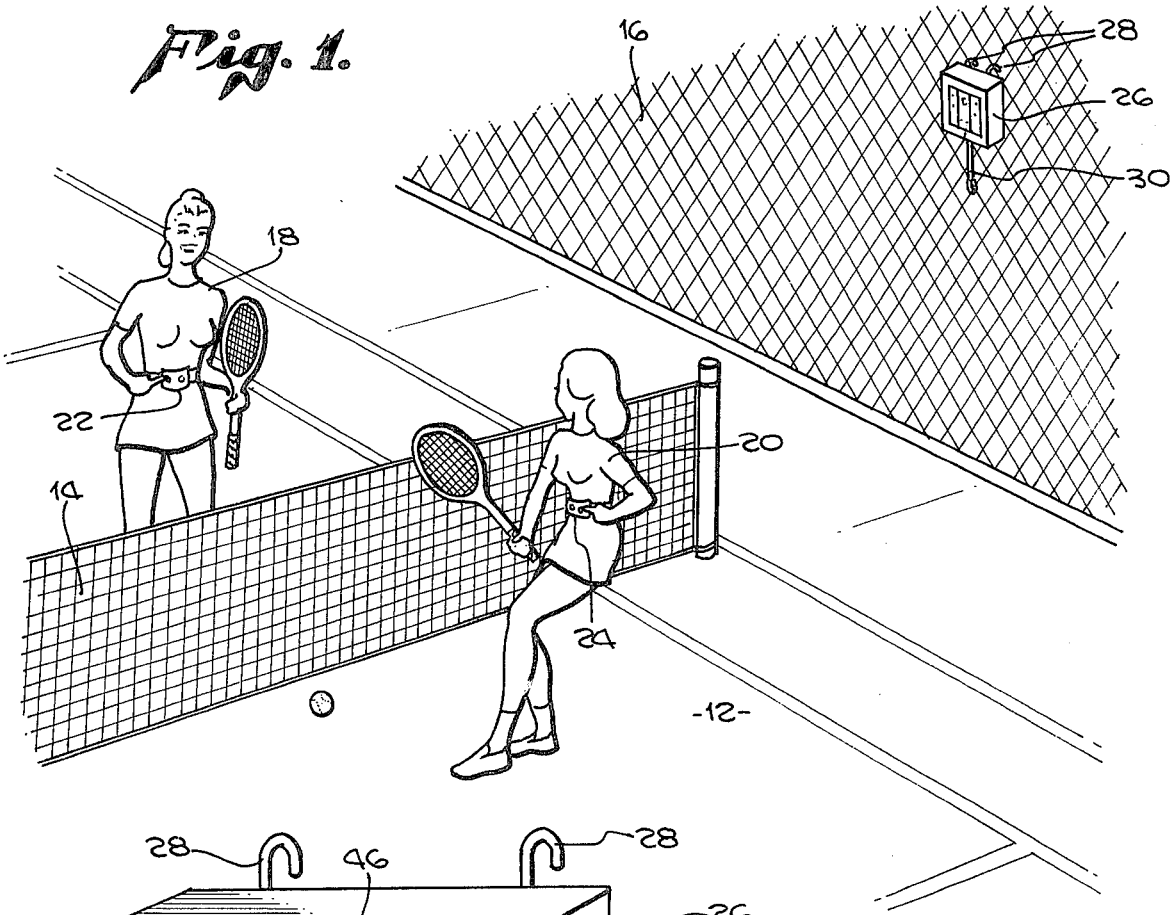
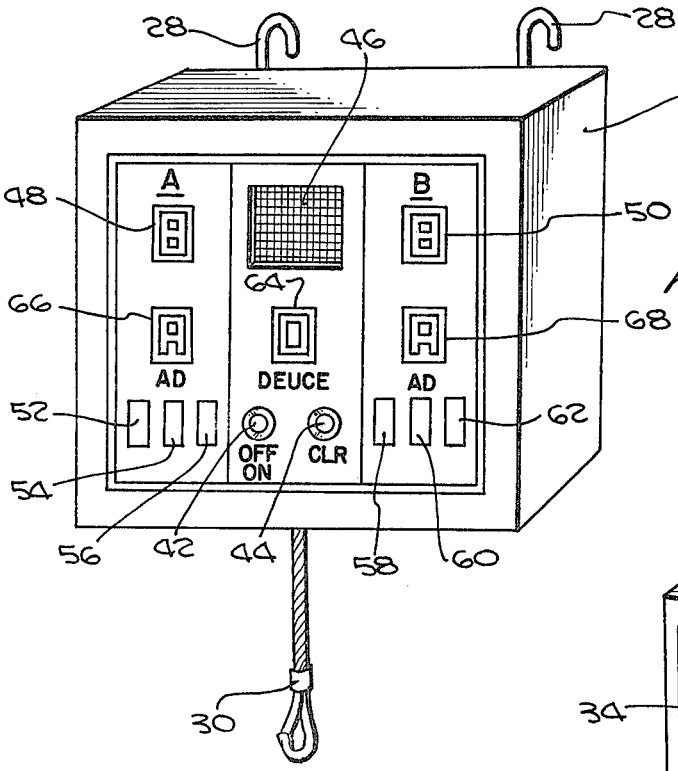
Fig. 3.
Fig. 2.
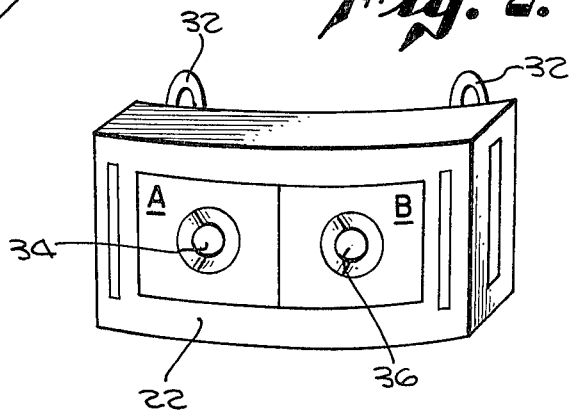

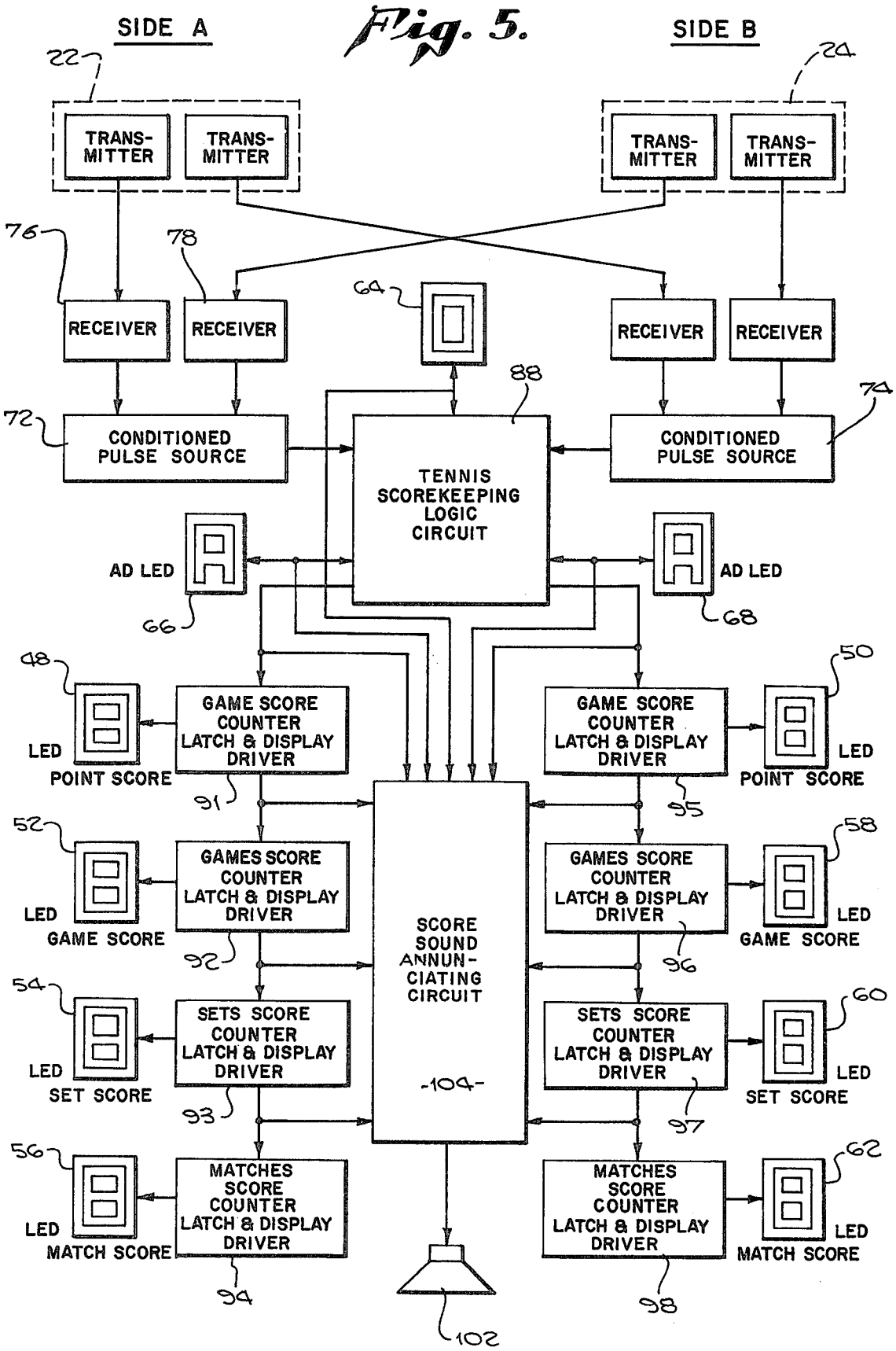
Fig. 5.
SIDE A
SIDE B
22
24
TRANS-MITTER
TRANS-MITTER
TRANS-MITTER
TRANS-MITTER
76
78
64
RECEIVER
RECEIVER
RECEIVER
RECEIVER
88
72
74
CONDITIONED PULSE SOURCE
TENNIS SCOREKEEPING LOGIC CIRCUIT
CONDITIONED PULSE SOURCE
AD LED
AD LED
66
68
48
50
GAME SCORE COUNTER LATCH & DISPLAY DRIVER
GAME SCORE COUNTER LATCH & DISPLAY DRIVER
LED POINT SCORE
LED POINT SCORE
91
95
52
58
GAMES SCORE COUNTER LATCH & DISPLAY DRIVER
GAMES SCORE COUNTER LATCH & DISPLAY DRIVER
LED GAME SCORE
LED GAME SCORE
92
96
SCORE SOUND ANNUN-CIATING CIRCUIT
-104-
54
60
SETS SCORE COUNTER LATCH & DISPLAY DRIVER
SETS SCORE COUNTER LATCH & DISPLAY DRIVER
LED SET SCORE
LED SET SCORE
93
97
56
62
MATCHES SCORE COUNTER LATCH & DISPLAY DRIVER
MATCHES SCORE COUNTER LATCH & DISPLAY DRIVER
LED MATCH SCORE
LED MATCH SCORE
94
98
102

ELECTRONIC TENNIS SCORING SYSTEM

FIELD OF THE INVENTION

This invention relates to electronic score keeping arrangements of games.

BACKGROUND OF THE INVENTION

Anyone who has played tennis to any substantial extent has encountered problems in recalling the score and has become involved in time-consuming discussions with the opponent relative to the score. While a number of mechanical or electrical score-keeping devices have been proposed heretofore, these have tended to be unduly cumbersome or heavy, and frequently have not been designed to either keep proper score for a tennis match or to solve the score-keeping problem from a player's viewpoint. Prior patents relating to scoring apparatus for sports contests include J. F. Lohstroh, U.S. Pat. No. 545,601, granted Sept. 3, 1895; S. D. McElroy, U.S. Pat. No. 565,141, granted Aug. 4, 1896; H. H. Kucks, U.S. Pat. No. 2,455,422, granted Dec. 7, 1948; R. G. Bowman, U.S. Pat. No. 3,366,945, granted Jan. 30, 1968; G. O. Saile, Jr., et al, U.S. Pat. No. 3,254,433, granted June 7, 1966; J. F. Abbott, U.S. Pat. No. 3,651,507, granted Mar. 21, 1972; and British Patent No. 338,849 to B. E. Foster, granted Jan. 21, 1931. However, these patents do not appear to include the following features: (1) Accommodation to the complexities of tennis scoring, including advantages, deuce games, and six games winning a set; (2) the requirement of concurrence by both opponents in order to register a point; (3) self-contained portable wireless input units carried by each player; and (4) wireless input units for indicating whether one opponent or the other opponent won successive points.

A principal object of the present invention is to avoid the arguments which can arise in the course of tennis matches, when concentration on a particular lengthy point may tend to cause the players to forget the score. Additional objects of the present invention include provision of a tennis scoring system which provides the features enumerated hereinabove.

SUMMARY OF THE INVENTION

In accordance with one broad aspect of the invention, a tennis scoring system is provided in which both of the two opponents are provided with alternate input switches to indicate either that one opponent or the other won the particular point which has just been completed. In addition, score registering and displaying equipment is included in the system to register and display scores only when concurrent signals are provided from both of the two opponents.

In accordance with another broad feature of the invention, the two opponents may be provided with miniature portable input units with input switches for the wireless transmission of alternate signals to indicate that one party or the other won the most recently played point.

In addition, the input switches are protected against inadvertent actuation by recessing or comparable arrangements.

In accordance with a further feature of the invention, electronic logic circuitry is provided for recording, calculating, and indicating deuce scores in tennis games and/or indicating which of the two opponents have the advantage after the point following a deuce score.

In accordance with a further aspect of the invention, miniature wireless transmitting and receiving equipment is provided for processing input signals from each of the two opponents and for displaying the correct tennis score at all times. A larger size receiver and display apparatus may be provided for receiving signals from both players and visibly displaying the score at the side of a tennis court; or alternatively, the portable unit carried by each player may include substantially duplicate scorekeeping and displaying arrangements so that a separate unit is not required at the side of the courts or hanging on the tennis court fence.

In accordance with another broad aspect of the invention, first and second electronic transmitting devices are provided to be operated by one side or the other, respectively, to indicate which side won each successive point; and the receiving and scoring unit includes a first circuit for storing a preliminary indication as to which side won the point, and additional logic circuitry for preventing the full recording and display of the point if it is disputed by the other side.

A loud speaker may also be included in the system to provide a confirmatory unique audio signal to indicate when one opponent or the other has won a point or a game.

Other objects, features, and advantages of the invention will become apparent from a consideration of the following detailed description and from the accompanying drawings.

BRIEF DESCRIPTION OF THE DRAWINGS

FIG. 1 is a diagrammatic showing of the system of the invention in use in a tennis court environment;

FIG. 2 shows an input unit about the size of a belt buckle to be carried by one of two opponents in the tennis match;

FIG. 3 shows a receiver and tennis score calculator and display apparatus;

FIG. 5 is a block circuit diagram of the complete system; and

DETAILED DESCRIPTION

Figure 4:
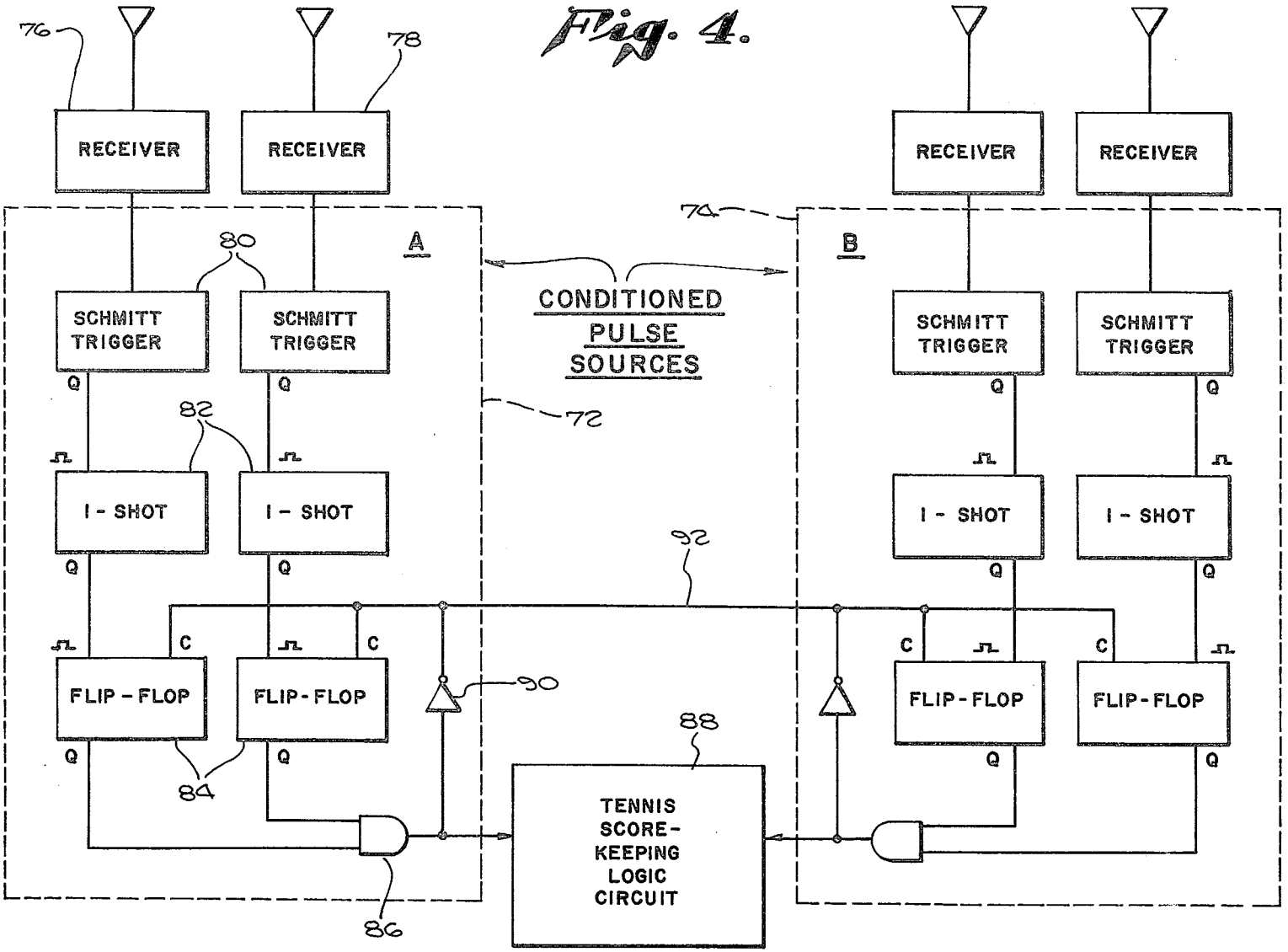
FIG. 4 is a block circuit diagram indicating the initial processing of signals received from the input units of FIG. 2 at the receiver of FIG. 3.

Referring more particularly to the drawings, FIG. 1 shows the system of the invention in use. More specifically, FIG. 1 shows a tennis court 12 equipped with the usual tennis net 14 and fence 16, and is complete with two opponents 18 and 20. The equipment making up the illustrative system of the present invention includes the portable score input units 22 and 24, worn by the girl tennis players 18 and 20 at their waists, and the tennis scorekeeping and display unit 26 which is mounted on fence 16, by the hooks 28 and the clip 30.

FIGS. 2 and 3 are detailed showings of one of the score input units 22, and the common scorekeeping and display unit 26, as shown in FIG. 1.

The input unit 22 of FIG. 2 is provided with belt clips or loops 32 for securing the unit to a belt or to the waist. Recessed pushbutton switches 34 and 36 are provided to indicate which of the two opponents won the preceding point. The units 22 and 24 are a matched pair and carry letters "A" and "B," and a prior agreement is made between the parties as to which designation shall apply to specific players. Each of the units 22 is a miniature transmitter similar to the hand-held garage door operating signallers, and transmits on one frequency or another depending on whether pushbutton 34 or 36 representing point won by player A or player B, respectively, was depressed, Of course, any suitable modulation scheme may be employed to distinguish signals arising from depressing pushbutton 34 or 36, in accordance with principles well known in the art.

FIG. 3 is a detailed showing of the receiver, scorekeeping circuit, indicator and annunciator unit 26, which is employed in the version of the present invention as illustrated in the drawings. More specifically, the unit 26 includes an off-on switch 42, a clear switch 44, a speaker having an output grille 46, and a number of electronic digital display arrays, preferably of the light-emitting diode type. The display arrays include identical displays for side A and side B, and more specifically include the point indicating display arrays 48 and 50, and the game, set, and match indicating digital display arrays 52, 54 and 56 for side A; and 58, 60, and 62 for side B. In addition, the indicator 64 represents a deuce game, and the indicators 66 and 68, respectively, show that side A or side B, respectively, have an advantage. As discussed below, the unit 26 may provide distinct audio signals from speaker enclosure 46 indicating the winner of specific points, and also of games, sets, and/or matches.

Referring to FIG. 4, this block circuit diagram indicates the input signal processing at unit 26 for signals received as points won by side A or side B, which are processed by circuits 72 and 74, respectively. More specifically, referring for the moment to side A and circuit 72, the input receivers 76 and 78 receive signals from input units 22 and 24, worn by the opposing players as shown in FIG. 1. These signals, which may arrive in succession, are applied to the Schmitt trigger circuits 80, to the one-shot multi-vibrators 82 and to the flip-flops 84. Outputs from the flip-flops 84 are applied to the AND circuit 86 and then to the scorekeeping logic circuit 88. In addition, output pulses from AND gate 86 are applied to the inverter circuit 90 to clear flip-flops 84. Incidentally, it may be noted that the one-shot multi-vibrators or monostable multi-vibrators 82 are employed to avoid double counting in the event that there is contact bounce or inadvertent double pressing of an input pushbutton. Furthermore, it may also be noted that, if one opponent initially depresses an A input pushbutton indicating that side A won the point, note that this causes one of the flip-flops 84 to be set to its energized state, but not the second of the flip-flops 84. Then, if both parties depress the B pushbutton switch indicating that side B won the point, the clear line 92 will be energized and all of the flip-flops will be reset to their original state, and a pulse is transmitted to the B side of the tennis score-keeping logic circuit 88.

Incidentally, it may be noted that conventional logic symbolism is employed in the present circuits with an AND gate being represented by a circuit block such as block 86 having a rounded output and a flat input side. Amplifiers are represented by equilateral triangles, and inverting amplifiers are shown by a triangle with a small circle at the output side of the amplifier triangle. OR gates are shown by circuit symbols in which the input side is concave, and the output sides come to a point.

The block diagram of FIG. 5 will now be considered. It overlaps to some extent the system shown in prior figures of the drawing. More specifically, the units 22 and 24 are shown at the top of FIG. 5, and as mentioned above, each include two transmitters. Circuits 72 and 74 and the associated receivers were considered in connection with FIG. 4 of the drawings. These circuits serve to receive and condition the input pulses transmitted by units 22 and 24 either for side A or for side B.

The various electronic numerical displays which were shown in FIG. 3 also appear in FIG. 5 in terms of their location with respect to the circuit diagram. These LED displays include the deuce array 64, the ad display arrays 66 and 68, the point score arrays 48 and 50, the game score arrays 52 and 58, the set score arrays 54 and 60, and finally the match score display arrays 56 and 62. With regard to the deuce score display arrays 64 and the ad score array 66 and 68, they may take the form of a "D" for display 64, and as an "A" for the advantage displays 66 and 68. Alternatively, because these three displays have only "on" and "off" states, they may be implemented by a simple lamp bulb or a single LED of high intensity. Of course, the use of the letters "D" and "A" have the advantage of indicating to the players or the spectators the fact that it is a deuce game or that one party has the advantage with more clarity.

Electronic digital displays may normally include seven or more segments. Standard numerical display driver circuits are commercially available to count or to register input binary signals and to display the indicated decimal number through the use of such driver and latch circuitry which is of standard configuration. Every hand-held calculator includes this type of circuitry. In FIG. 5, the point, game, set, and match score counters and the associated latch and display drivers are indicated by the blocks 91 through 98, with circuits 91 through 94 being associated with side A, and circuits 95 through 98 being associated with side B.

The speaker 102 is energized from suitable audio circuitry 104 to provide distinct audio output signals to indicate point, game, set, and match registration action of the logic circuitry. Thus, for example, points awarded to side A may be accompanied by a brief low-pitched note applied over speaker 83, whereas points awarded to side B may be accompanied by a higher pitched tone. Other simple and easily generated sounds may be readily provided to respond to the other inputs to the audio circuitry.

Figure 6:
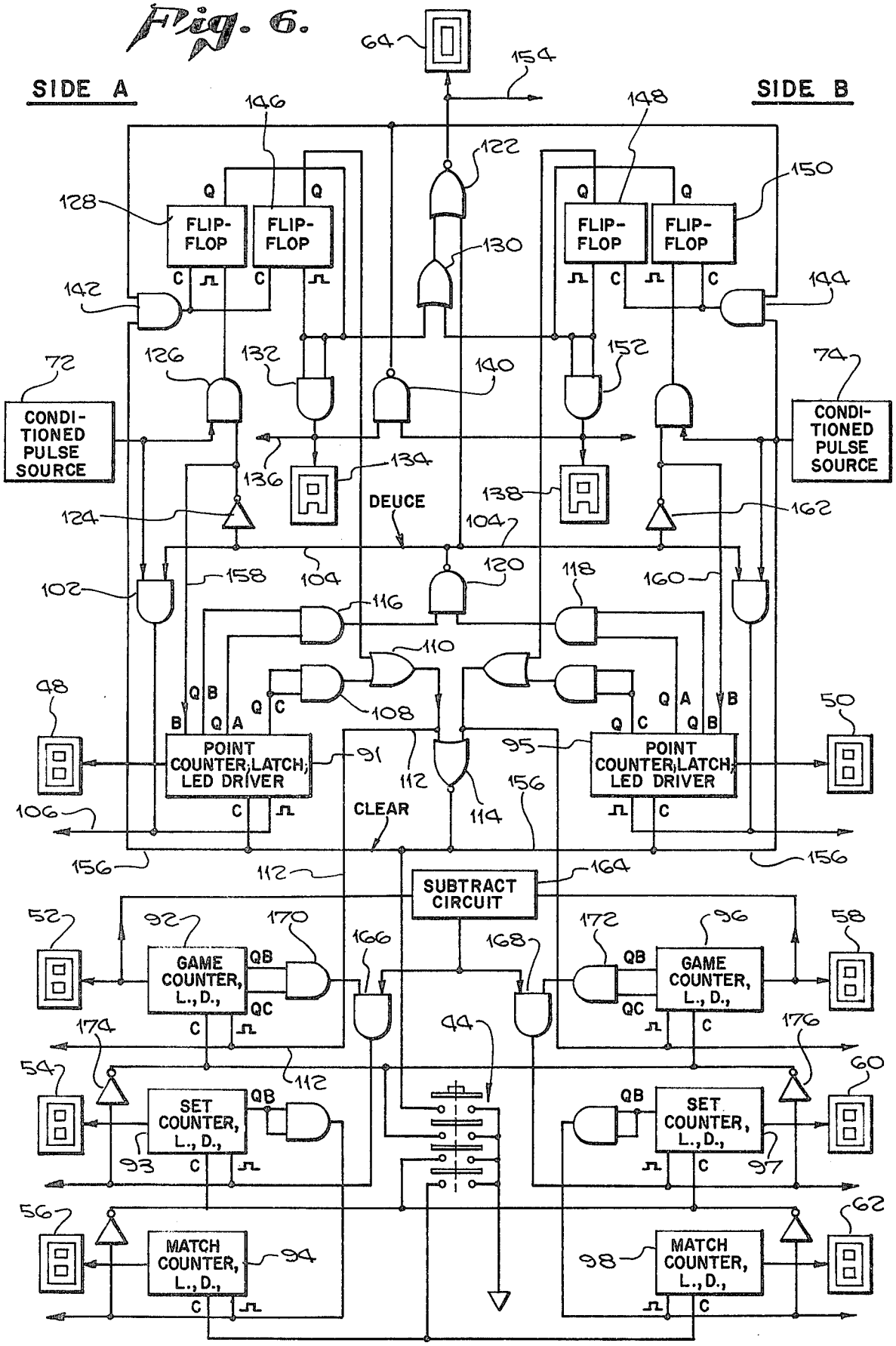
FIG. 6 is a logic circuit diagram showing the scorekeeping logic circuitry included in the receiver of FIG. 3.

Referring now to FIG. 6, this logic circuit diagram shows the detailed mode of operation of the scorekeeping arrangements. More specifically, note that input signal representing a point for side A appears at the output of block 72 at the left-hand side of FIG. 6, while input signals representing a point for side B appear at the output of circuit 74 at the right-hand side of FIG. 6. AND gate 102 is therefore energized by the output from circuit 72. The other input to the AND gate 102 is line 104, which is referred to as the deuce line. It is normally in the high or positive state, and shifts to the low state only when a deuce game of tennis is in progress, as described hereinbelow. Accordingly, at the start of the match, with the deuce line 104 providing a high input to the AND gate 102, a pulse is gated through AND gate 102 to the point counter circuit 91. Lead 106 connects to the sound enunciating circuit 104 which appears in FIG. 5. When point counter 91 reaches 4, indicating that side A has won the game, both of the inputs to AND gate 108 are energized, and the pulse passes through OR gate 110, and a pulse is applied on lead 112 to the game counter 92. A clear signal is also applied through OR gate 114 to the clear input of point counter 91.

Now, considering the deuce function, when both point counters 91 and 95 are simultaneously set to 3, the first two latch outputs $Q_A$ and $Q_B$ of the binary counters 91 and 95 are energized, and this produces an output from the AND gates 116 and 118, which in turn energizes the NAND gate 120 to drive the deuce line 104 to its low state. This signal is applied to the NOR circuit 122 which illuminates the deuce signal display 64 which appears at the top of FIG. 6. In addition, when the deuce line 104 is driven low, the inverter 124 supplies one positive input to the AND gate 126. Upon the arrival of the next point for side A, the other input to AND gate 126 is energized and flip-flop 128 is energized, causing its output Q to go to the high state. OR gate 130 transmits the resultant positive signal to the NOR gate 122 which turns off the display 64. AND gate 132 is turned on, illuminating the ad display 134 and also sending an indication signal to the annunciator circuit on line 136. Incidentally, as previously mentioned, all of the arrows directed outwardly from the circuit of FIG. 6 are connected to the annunciator circuit.

The circuitry described hereinabove for player A's side finds its equivalent on player B's side, with the ad display 138 being illuminated in the event of an ad for player B.

In the event that, following an advantage for player A, player B wins the next point, both inputs to the NAND gate 140 are energized and the resultant low signal is applied to the AND gates 142 and 144, thereby clearing and resetting flip-flops 128, 146, 148, and 150. This removes the inputs to AND gates 132 and 152, de-energizing the two advantage-indicating LED's 134 and 138. With both flip-flops 128 and 150 being in their reset state, their "Q" outputs are low, thus producing a low output from the OR gate 130. Since the other input to the NOR gate 122 is also low, the output from the NOR circuit 122 to the deuce signal LED 64 is high, and the deuce LED is energized with a concurrent signal being applied to lead 154 to energize the audio annunciator circuit.

The aforementioned deuce-ad-deuce-ad states will repeat indefinitely as long as players A and B alternately score points. If, however, either player scores two consecutive points after deuce, a game point is registered in much the same manner as described previously in connection with a game which is won without going through the deuce sequence. More specifically, assuming that a player "A" has won the first point following a deuce, and that he has an ad, then flip-flop 128 is in the energized state. Another point won by player A will cause the transmission of a second pulse through the AND gate 126, thereby resetting flip-flop 128 and setting flip-flop 146 to the energized state. This will transmit a high signal from the "Q" output of flip-flop 146 through the OR gate 110, which also receives game points from the point counter, latch, and LED driver 91, as described hereinabove. The action is clearing circuit 91 and in transmitting a game signal to the game counter, latch and LED driver 92 is the same as described hereinabove. It is also noted that a clear signal is applied from the output of NOR gate 114 to the clear line 156. Further, the clear signal is low, and this low is also applied to the AND gates 142 and 144, which pass a momentary low to clear and reset flip-flops 128, 146, 148, and 150. As soon as the positive signal at the output of flip-flop 146 clears, the deuce line 104 and the clear line 156 revert to their normal high states, and the point counting logic circuitry is ready for the next game. Of course, the same holds true for the B side of the logic circuitry.

Incidentally, with regard to the point counter displays 48 and 50, they may either hold at the 3 count required for deuce, or they may be blanked out by the blanking circuits 158 and 160 leading to the "B" input of point counters 91 and 95, respectively, from the inverters 124 and 162, which are high in the deuce state.

Now, referring to the game counters, latches and LED drivers 92 and 96, these operate in much the same manner as described hereinabove for the point counter circuits with the exception that the deuce and the ad functions are not included. In addition, to accommodate the requirement in tennis scoring that a set must be won by two games, the subtraction circuit 164 and the two AND gates 166 and 168 are provided. The subtraction circuit 164 provides an output to the two AND gates 166 and 168 whenever the difference between the games registered by the two games counter circuits 92 and 96 is equal to or greater than two games. Assuming that this is the case, whenever the outputs $Q_B$ and $Q_C$ from either game counter 92 or 96 indicate an output of 6 and energize the AND gates 170 or 172, the pulse is tranmitted through AND gate 166 or 168 and the set counter 93 or 97 is advanced. Concurrently, inverters 174 and 176 provide resetting signals to the game counters 92 and 96.

As an optional feature, the match counters 94 and 98 may be provided to total the number of matches won by each side.

Reset switch 44 may be provided to clear all of the displays.

Instead of employing a separate single unit to keep score and hanging this unit on the side of the court, on the fence or the like, individual scorekeeping units may be combined with the score input units. More specifically, the unit of FIG. 3 may be combined with each of the two units carried by the players, as shown in FIG. 2. Under these circumstances small LED displays of the type shown in FIG. 3 may be provided on each of the input units as shown in FIG. 2. With such an arrangement, the complete circuit of FIG. 4 would be replicated at each of the two portable units, and nearly all of the circuitry of FIG. 5 would also be included. Of course, the local signals would not need a receiver, but two transmitters would be used at each location to provide the feature of confirmation to the other player, of the point being won by either player A or player B. In addition, if desired, the audio circuitry feature could be dropped, as this might involve more weight than would be desired for carrying by each player. With logic circuitry being as compact as it now is, the matter of replicating the logic circuitry of FIG. 6 would be of minor consequence.

For completeness, it may be noted that in the foregoing description that the digital numerical displays have been described as light emitting diodes to indicate one practical alternative. It is to be understood that any other desired form of indicator, such as liquid crystals, nixie tubes, incandescent or fluorescent lamps, etc., could be used in accordance with power requirements, cost, output illumination, and other factors. In the description, side A and side B were employed; however, color coding of switches and indicators or any other desired indicating system could be used. It is also noted that, in FIGS. 2 and 3 certain specific arrangements including hooks and/or metal loops were shown for securing the units to the fence or to the apparel of the players. Other types of loops, straps, clips, or other arrangements could of course be used to supplement or instead of the indicated securing elements. With regard to the switches shown in FIGS. 2 and 3, the recessing serves to avoid undesired operation by impact either by a tennis ball or the body, and this result could be achieved by other arrangements such as double switches, covers for the switches, for example. Concerning another minor aspect of the present disclosure, antenna symbols appear in the drawings, and represent the pickup or transmission points for the R.F. signals. They may be implemented, as noted elsewhere in the specification in any conventional manner.

Incidentally, concerning symbols which are used in the present drawings, the pulse (Ω) symbol is the positive pulse incrementing input to flip-flops, counters, and one-shot multivibrators, for example; Q is the output of a digital device such as a flip-flop, and QB and QC represent the outputs of successive stages of a counter; C is the "clear" input to a flip-flop or a counter; and the symbol "B" adjacent a counter indicates a blanking input.

Referring now to review the mode of operation of the system from a "logic" point-of-view, it may be noted that, in the implementation disclosed hereinabove, both sides have two input switches, one to record a point for side "A," and another to record a point for side "B." In the logic circuitry, when a first indication that side A won the point is received, a preliminary indication is stored indicating that side A won the point; however, if player B disputes the point and either sends an opposing signal, or no confirming signal, no permanent recording in favor of A or displaying of the changed score occurs. The logic circuitry for recording the preliminary indication is one of the flip-flops 84 in FIG. 4, and additional logic circuitry for preventing full recording and display if the point is disputed includes the other flip-flop 84 and the AND circuit 86. It is noted in passing that much the same result could be accomplished using only one input from each side, with slightly modified receiver and processing circuitry. Thus, a preliminary indication would be recorded upon the arrival of an "A" pulse, and after a predetermined time interval (if no intervening signal arrives) this "A" pulse would be recorded and displayed. However, if player B disputes the point, he would promptly depress his input switch and the arrival of a "B" pulse would inhibit the operation of the permanent scoring and display operation. With this arrangement, of course, only one transmitter is required form each side. Further, when two combined input and score-keeping units are used, without a separate scorekeeping unit, only one transmitter would be required from each unit.

In closing, it is to be understood that the present tennis scoring system may be implemented in accordance with any desired electronic logic system of components. Further, while the particular arrangement of AND, OR, NAND, NOR gates, flip-flops, etc. as described in the present Detailed Description constituted one effective and workable method for implementing the present invention, other systems of logic components could also be employed. Also, the input switches could be of the capacitive type frequently used in elevators, or of any other convenient form. In addition, while the present system is primarily intended for use in tennis matches, it could also be employed in connection with other types of sporting contests.

What is claimed is:

1. An electronic scoring system for keeping score between two opposing sides each including one or more opponents, comprising:

a first electronic transmitting device to be selectively actuated by one side to indicate which side won each successive point;

a second electronic transmitting device to be selectively actuated by the other side to indicate which side won each successive point;

receiving and scoring means for initially storing a preliminary indication as to who won each successive point;

additional logic circuit means for preventing the full recording of the preliminary indication if it is disputed by the other side; and means for fully recording the point if it is not disputed, and for displaying the resultant score.

2. An electronic scoring system as defined in claim 1 wherein each said transmitting device includes two switch means for selective actuation to indicate that one party or the other won each successive point.

3. An electronic scoring system as set forth in claim 2 wherein both of said transmitters include means for transmitting different signals to indicate alternatively whether one side or the other has won a point; and means are provided for only recording a point for one side or the other when both transmitters send signals confirming that one particular side has won the point.

4. An electronic scoring system as defined in claim 1 wherein means are provided for securing said first transmitting device to a player on one side and said second transmitting device to a player on the other side.

5. An electronic scoring system as defined in claim 1 wherein said receiving and scoring logic circuitry is mounted in a separate unit which displays the score for viewing by both sides.

6. An electronic scoring system for tennis as defined in claim 5 further comprising:

means for securing said separate logic and display unit to a tennis fence.

7. An electronic scoring system as defined in claim 1 further comprising:

means for providing distinctly different audio signals indicating score changes for the different sides.

8. An electronic scoring system for tennis as defined in claim 7 wherein a separate deuce signal and two separate advantage signals are provided.

9. An electronic scoring system for tennis as defined in claim 1 further comprising:

means for displaying the tennis point score, including means for indicating deuce and advantage scores;

means for displaying the game score; and means for displaying set score.

10. An electronic scoring system as defined in claim 1 further comprising:

means including a plurality of multi-segment electronic displays for indicating the score.

11. A tennis electronic scoring system as defined in claim 1 including:

tennis point counter means for each side;

game counter means for each side;

set counter means for each side; and means for clearing both of said point counter means when either of said game counter means is advanced; and means for clearing both of said game counter means when either of said set counter means is advanced.

12. A system as defined in claim 1 further comprising:

means for protecting said transmitting devices against inadvertent actuation, whereby a game ball or accidental bodily movement will not actuate said switches.

13. An electronic scoring system for keeping score between two opposing sides each including one or more opponents, comprising:

first and second electronic transmitting devices each including at least one input switch to be selectively actuated in favor of one side or the other to indicate which side won each successive point;

means for securing said first transmitting device to a player on one side and said second transmitting device to a player on the other side; and receiving and scoring logic circuitry for recording inputs from said first and said second transmitters and for displaying the resultant score.

14. A system as defined in claim 11 further comprising:

means for protecting said switches against inadvertent actuation, whereby a game ball or accidental bodily movement will not actuate one of said switches.

* * * * *